United States Patent [19]

Gitman

[11] Patent Number: 4,890,562

[45] Date of Patent: Jan. 2, 1990

[54] METHOD AND APPARATUS FOR TREATING SOLID PARTICLES

[75] Inventor: Gregory M. Gitman, Duluth, Ga.

[73] Assignee: American Combustion, Inc., Norcross, Ga.

[21] Appl. No.: 199,248

[22] Filed: May 26, 1988

[51] Int. Cl.[4] ..... F23G 7/00

[52] U.S. Cl. ..... 110/236; 110/244; 110/346; 431/284

[58] Field of Search ..... 110/236, 237, 243, 244, 110/346; 431/283, 284, 285

[56] References Cited

U.S. PATENT DOCUMENTS

| | | | |
|---|---|---|---|
| RE. 28,787 | 4/1976 | Moore | 110/236 X |
| 3,615,213 | 10/1971 | Shepherd | 431/284 X |
| 3,644,076 | 2/1972 | Bagge | 431/284 |
| 3,830,172 | 8/1974 | Hindenlang | 110/244 X |
| 3,861,330 | 1/1975 | Santoleri | 110/244 |
| 4,462,318 | 7/1984 | Carbeau et al. | 110/244 X |
| 4,648,333 | 3/1977 | Mudd et al. | 110/236 X |

*Primary Examiner*—Edward G. Favors

*Attorney, Agent, or Firm*—Needle & Rosenberg

[57] ABSTRACT

A method and apparatus is disclosed for high intensity treatment of solid particles in a combustion chamber (10) by introducing the particles into the combustion chamber (10) as a plurality of streams (30, 32, 34, 36) wherein fuel is introduced to the combustion chamber within the area formed by the streams of particles and fuel is also introduced into said combustion chamber so that it surrounds the stream of particles, and by introducing oxidizing gas into the combustion chamber so that the oxidizing gas mixes with and combusts the fuel to produce a first high intensity flame located within the area formed by the particle streams and a second high intensity flame surrounding the particle streams.

26 Claims, 2 Drawing Sheets

METHOD AND APPARATUS FOR TREATING SOLID PARTICLES

The present invention relates to the combustion industry. More particularly, it relates to a method and apparatus for treating solid particles in a flame to rapidly heat their surface to change the physical and the chemical properties of the particles.

Small solid particles, such as fly and bottom ash from incinerators, fly ash from electric arc furnaces, and glass beads from blasting machines used for paint removal, may be contaminated with hazardous organics and metals. Such particles are often classified as a hazardous waste under environmental laws and must be treated before disposal or reuse to remove organic components and to form, if desired, an agglomeration of particles.

The flame treatment of solid particles by injection of the particles throughout conventionally arranged flame patterns has been known for some time. The known state of the art, however, does not efficiently use combustion energy, does not provide consistent treatment quality and does not have sufficient throughput capacity. These inefficiencies have made flame treatment technically and economically unattractive for many industrial applications.

The primary reason for such deficiency of flame treatment results from the inability to create a specific flame pattern structure to provide simultaneous control over the uniformity of particle heating, the necessary high rate of heat flux from combustion products to the particles, the retention time and the uniformity of distribution of oxidation or reduction of components in the gases contacting the particles being treated. In addition, the presently available methods for flame treatment are not capable of providing an adequate agglomeration of hot treated particles when desired. Such agglomeration is necessary to prevent leaching of particles into the groundwater during storage or when placed in a landfill by substantial reduction of total surface of treated particles.

There exists, therefore, a need for an improved method and apparatus for treating solid particles such as fly ash and bottom ash.

There also exists a need for such a method and an apparatus which agglomerates such particles.

SUMMARY OF THE INVENTION

The present invention provides a method and apparatus for removing organic components from solid particles and for agglomerating such particles into larger particles, thereby decreasing their total surface area.

The apparatus has a burner having a combustion chamber for creating a flame. Feeder means are provided for carrying solid particles from a storage container or other source to the combustion chamber. Fluidized carrier means may be present for providing air or other fluid used to aid in carrying the particles to the chamber. The particles are introduced into the chamber as a number of streams from a plurality of openings away from the center of the chamber. Fuel introduction means are provided for introducing fuel into the chamber from at least two openings in two different directions so that one fraction of the fuel is directed toward the outside space in the chamber surrounding the streams of particles and the second fraction of the fuel is directed towards the center space surrounded by the particles. Oxidizing gas introduction means are provided for injecting oxidizing gas to mix with each of the fuels independently to create a high temperature flame pattern both outside the particle streams and at the center of the streams. It is preferable that at least one oxidizing gas introduced toward the center space of the flame have an average concentration of total oxygen substantially above that of air, i.e., above 21% to produce high intensity flames. The particles are, therefore, enveloped by the flames and the contaminants are destroyed. The oxidizing or reducing characteristics of the flame is controlled by controlling the ratio of fuel to total oxygen used to generate the flame.

When agglomeration of the particles is desired, the streams may be directed into the combustion chamber in a crossing path so that the particle of the various streams collide with other particles from other streams. In this way, the surface of the particles become soft during the heating in the flame and form agglomerations upon impact with other particles. An additional stream of an agglomerating enhancing agent, such as salt having a low melting point, may be introduced to the particles either prior to or during treatment.

Therefore, it is an object of the present invention to provide a method and apparatus for destroying contaminants in solid particles.

It is also an object of the present invention to provide such a method and apparatus which agglomerates such particles.

These and other objects and advantages of the present invention will appear from the following description with reference to the drawings.

DETAILED DESCRIPTION OF THE DRAWINGS

The preferred embodiment is now described with reference to the drawings, in which like numbers indicate like parts throughout the views.

Figures 1, 2:
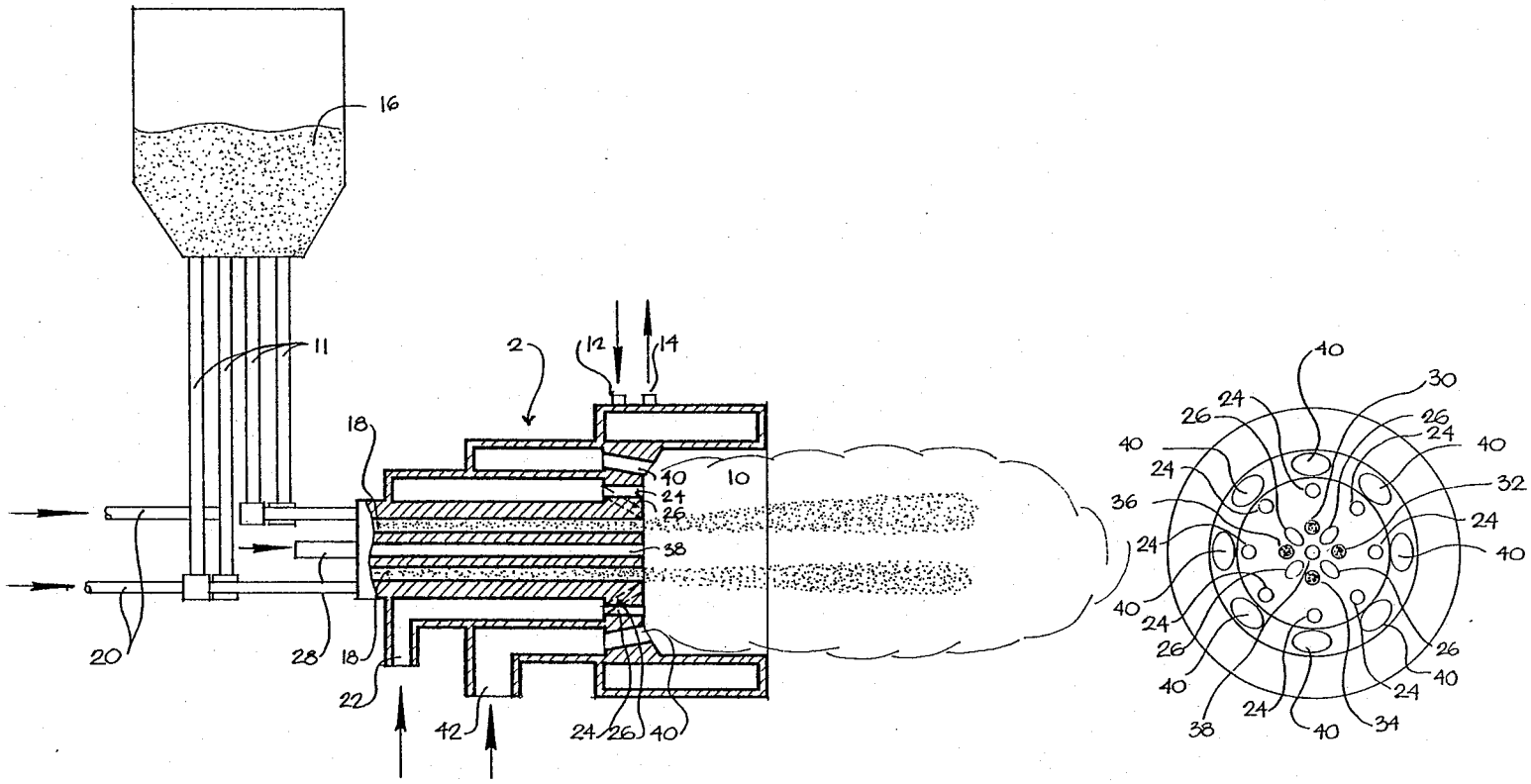
FIG. 1 is a cross-sectional view of an apparatus according to the present invention.
FIG. 2 is a section taken along line 2—2 of FIG. 1.
Figure 3:
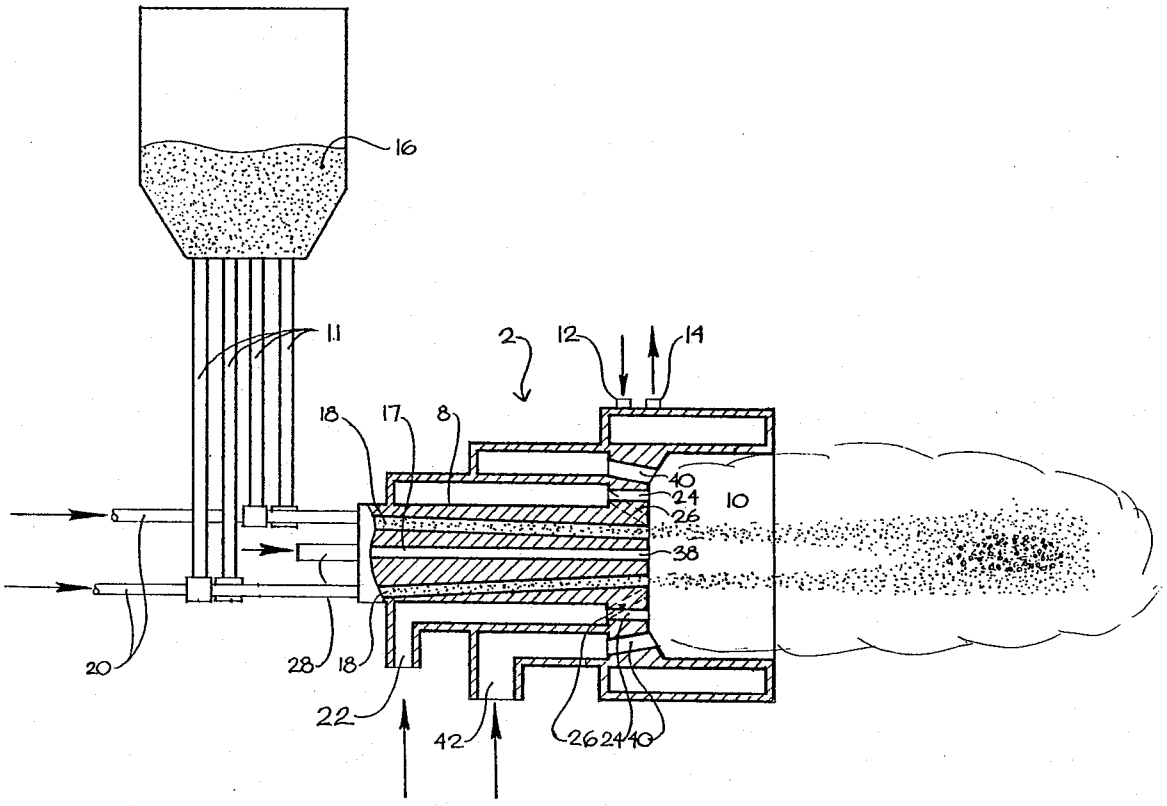
FIG. 3 is a cross-sectional view of an apparatus according to the present invention.

Referring to FIGS. 1 and 3, a burner 2 has a combustion chamber 10 which is cooled by water delivered through inlet 12 and exiting through outlet 14. A container 16 for storing solid particles prior to treatment is provided, although any outside source of particles may be used. A series of transport pipes 11 draw the particles from the container 16 and deliver the particles to fluid carrier pipes 20. The carrier pipes 20 are connected at one end to a source of pressurized fluid, such as air, and to feed conduits 18 at the other. The feed conduits 18 pass through the burner 2 and end in a series of feed outlets 30, 32, 34, 36 spaced along the inner wall of the combustion chamber 10, as seen in FIG. 2. The fluid aids in carrying the particles through the carrier pipes 20 and feed conduits 18 to the chamber 10.

Fuel supply pipes 22 for delivering controllable amounts of fuel to the combustion chamber 10 are provided. A first fraction of the fuel is directed from the first fuel outlets 24 towards the outside space surrounding the streams of particles entering the chamber 10 through outlets 30, 32, 34, 36, and a second fraction of fuel is directed from the second fuel outlet 26 towards the center space surrounded by the particles as they enter the chamber 10. It is preferably that the first and second fuel outlets 24 and 26 respectively be positioned at the inner wall of the chamber 10 alternating with each other in a circle. The first and second fuels may be identical, and may be delivered in the form of a stream, a mist or otherwise.

Means for supplying oxidizing gas to the combustion chamber 10 for combusting the particles are also provided. Preferably, the means include a first conduit 28 receivable connected at one end to a source of oxidizing gas and having an outlet 38 at the other end located within the center of the innerwall of the combustion chamber 10. The oxidizing gas from outlet 38 mixes with the second fraction of fuel introduced from fuel outlets 26 to form a high intensity flame within the space surrounded by the particle streams. Also included is a second conduit 42 receivable connected at one end to a source of oxidizing gas and emptying into the combustion chamber 10 at a number of outlets 40 surrounding both the particle outlets 30, 32, 34, 36 and the fuel outlets 24 and 26. The gas leaving the outlets 40 mixes with the first fraction of fuel introduced from fuel outlets 24 to form a high intensity flame surrounding the particle streams.

Alternatively, the first fuel may be delivered through the first conduit 28 and into the combustion chamber 10 through outlet 38, and the second fuel may be delivered through the second conduit 42 and into the combustion chamber 10 through outlet 40, and an oxidizing gas may be delivered through pipes 22 and into the combustion chamber 10 through outlets 24 and 26. In this manner, it is possible to deliver first and second fuels which are chemically different. As a result, the fuel delivered through outlet 38 may have a higher BTU value then that delivered through outlet 40, and an intense inner flame can be obtained. Of course, this configuration may also be used to deliver first and second fuels which are chemically similar.

When the apparatus is used to heat and/or decontaminate particles without agglomeration, the feed conduits 18 and outlets 30, 32, 34, 36 should be arranged in approximately parallel relation with each other so that the streams of particles entering the chamber 10 do not cross as shown in FIG. 1. When agglomeration is desired, the feed conduits 18 should be directed toward the axis of the combustion chamber 10 so that the streams of particles cross paths, sollide, and stick together, as shown in FIG. 3.

During operation, the heat is transferred from the walls of the combustion chamber 10 to the water entering through inlet 12 and exiting through outlet 14. Particles are carried through the carrier pipes 20 to the feed conduits 18 along with the fluid and are delivered into the combustion chamber 10. Simultaneously, the first fraction of fuel is delivered to the combustion chamber through first fuel outlet 24, and the second fraction of fuel is delivered to the chamber 10 through second fuel outlet 26. Oxidizing gas, preferably having an oxygen content higher than 21%, such as purchased oxygen or oxygen enriched air, is delivered to the combustion chamber 10 through first oxygen conduit 28 and outlet 38 and second oxygen conduit 30 and outlet 40 to mix with the fuel fractions. Mixing of the fuel and oxygen causes heat to be released inside and outside the particle streams so that the streams are surrounded by two flames. One fraction of the total fuel is being combusted in the center zone of the particle streams and the other fraction of the fuel is combusted in the peripheral zone of the flame surrounding the streams. These fractions are controlled by the ratio of the total cross-sectional area of the fuel outlets 24 and 26 delivering both fractions of the total fuel. Optionally, two oxidizing gases having different oxygen concentrations from each other may be delivered to the combustion chamber 10. In such a case, the gas delivered through the first oxygen conduit 28 should have the higher oxygen content in order to provide an adequate heating of the particles. The particles extract the heat from the smaller combustion volume located inside the flame center and from the larger combustion volume creating the outside portion of the flame envelope. Therefore, to provide uniformity of the heating, the adiabatic temperature and the amount of heat stored per cubic foot of combustion volume in the center volume of the flame should be higher than the same combustion parameters for the outside portion of the flame envelope.

Very high adiabatic flame temperatures are used to create a heat flux from the flames to the surface of the particles which is substantially higher than the heat transfer of particles heated by conductivity inside of the particles being heated. This results in a rapid temperature rise of the particle surface. The very short retention time spent by the particles inside the high temperature flames make it possible to heat the particle surfaces to a high temperature and allows vaporization and burning of organics, as well as the glassification of the particle surfaces, without heating through the entire bodies of the particles. This substantially reduces the amount of heat needed for thermally treating the surfaces.

When the particles should be treated without agglomeration, the particles are cooled down either on the fly by ambient air outside the chamber 10, by adding water, or by other cooling means. This cooling step is arranged in such a way that the surface temperature of the particles is substantially reduced prior to their contact with each other. When agglomeration is desired, the particles are directed through angled feed conduits 18 so that the particles are carried through the chamber, where they are partially preheated prior to impacting with each other. The preheated particles agglomerate upon impact. To improve particle agglomeration, a specific agglomerating enhancing agent, such as a salt having a low melting point, may be introduced to mix with the particles. This agent may be mixed with the particles prior to combustion or as a separate stream introduced into the chamber 10 which impacts on the particles after they are partially preheated. If agglomeration is not desired, the feed conduits 18 are positioned parallel so that collision by the particles upon entering the chamber 10 is minimized.

Many other industrial applications besides the removal of contaminants may utilize the present invention. Virtually any application which requires the rapid heating of particle surfaces is possible using the present invention. Examples include flame polishing of glass particle surfaces to produce reflecting glass beads and the burning off and recirculating of residual binders of chopped fiberglass wastes.

What is claimed is:

1. An apparatus for high intensity treatment of solid particles comprising:

(a) a combustion chamber;

(b) means for introducing said particles into said combustion chamber as a plurality of streams;

(c) first means for introducing fuel to said combustion chamber within the area formed by said streams of particles;

(d) second means for introducing fuel into said combustion chamber surrounding said streams of particles; and (e) means for introducing oxidizing gas into said combustion chamber so that said oxidizing gas mixes with and combusts said fuel to produce a first high intensity flame located within the space formed by said particle streams and a second high intensity flame surrounding said particle streams.

2. The apparatus of claim 1, wherein said means for introducing particles comprises a means for providing fluid under pressure for mixing with said particles prior to introduction into said combustion chamber for carrying said particles to said combustion chamber.

3. The apparatus of claim 1, wherein said means for supplying oxidizing gas supplies oxidizing gas having an average concentration of total oxygen higher than 21%.

4. The apparatus of claim 1, further comprising means for water-cooling said combustion chamber.

5. The apparatus of claim 1, wherein said means for introducing oxidizing gas directs a first oxidizing gas within the space formed by said streams of particles and directs a second oxidizing gas to surround said streams of particles.

6. The apparatus of claim 5, wherein said first oxidizing gas and said second oxidizing gas have different oxygen concentrations.

7. The apparatus of claim 1, wherein said first means for introducing fuel and said second means for introducing fuel provide fuels which are chemically different.

8. The apparatus of claim 1, and further comprising means for providing an agglomeration enhancing agent to said particles during treatment.

9. The apparatus of claim 1, wherein said means for introducing particles comprises a plurality of feed conduits in approximately parallel relationship to each other such that said streams of particles travel through said combustion chamber approximately parallel to discourage agglomeration of said particles.

10. The apparatus of claim 1, wherein said means for introducing particles comprises a plurality of feed conduits angularly disposed toward the axis of said combustion chamber to introduce said streams of particles in a crossing pattern so that said particles tend to collide and agglomerate after being heated.

11. A method of treating solid particles comprising the steps of:

(a) introducing said particles into a combustion chamber as a plurality of streams;

(b) delivering a first fuel to said combustion chamber within the area formed by said streams of particles;

(c) delivering a second fuel to said combustion chamber at points surrounding said stream of particles;

(d) introducing oxidizing gas into said combustion chamber so that said oxidizing gas mixes with and combusts said first and second fuels to produce a high intensity flame located within the space formed by said particle streams and a second high intensity flame surrounding said particle streams.

12. The method of claim 11, and further comprising mixing said particles with a fluid under pressure to aid in introducing said particles into said combustion chamber.

13. The method of claim 11, wherein said step of introducing oxidizing gas introduces and oxidizing gas having an average concentration of total oxygen higher than 21%.

14. The method of claim 11, wherein said step of introducing oxidizing gas to said combustion chamber comprises supplying said oxidizing gas within the space formed by said stream of particles and a second oxidizing gas to the area surrounding said streams of particles.

15. The method of claim 14, wherein said first and second oxidizing gases have different oxygen concentrations.

16. The method of claim 11, wherein said steps of introducing first and second fuels introduce two fuels which are chemically different.

17. The method of claim 11, and further comprising adding an agglomeration enhancing agent to said particles during treatment.

18. The method of claim 11, and further comprising adding an agglomeration enhancing agent to said particles prior to treatment.

19. The method of claim 11, wherein said particles are introduced into said combustion chamber in approximately parallel streams to discourage agglomeration of said particles.

20. The method of claim 11, wherein said particles are introduced into said combustion chamber in a crossing pattern of streams so that said particles collide and agglomerate after being heated.

21. The method of claim 11, wherein said particles contain contaminants.

22. The method of claim 11, wherein said particles are glass beads.

23. The apparatus of claim 1, wherein said first means for introducing fuel and said second means for introducing fuel provide fuels which are chemically similar to each other.

24. The apparatus of claim 1, wherein said first means for introducing fuel and said second means for introducing fuel provide fuels which are chemically different from each other.

25. The method of claim 11, wherein said steps of introducing first and second fuels provide two fuels which are chemically similar to each other.

26. The method of claim 11, wherein said steps of introducing first and second fuels provide fuels which are chemically different from each other.

* * * * *